United States Patent [19]

Choate

[11] 4,131,104

[45] Dec. 26, 1978

[54] LOG-BURNING STOVE

[75] Inventor: James R. Choate, Rochester, N.H.

[73] Assignee: Hydraform Products Corp., Rochester, N.H.

[21] Appl. No.: 789,517

[22] Filed: Apr. 21, 1977

[51] Int. Cl.[2] ..... F24C 1/00

[52] U.S. Cl. ..... 126/60; 126/190; 214/18 R; 292/54

[58] Field of Search ..... 214/77 R, 84, 18 R; 126/190, 60, 62, 64, 65, 58, 120, 121, 194, 197; 110/116; 432/250; 237/52; 292/54 X

[56] References Cited

U.S. PATENT DOCUMENTS

| | | | |
|---|---|---|---|
| 1,475,838 | 11/1923 | Lamb | 126/194 |
| 1,514,769 | 11/1924 | Johnston et al. | 214/77 R X |
| 1,940,685 | 12/1933 | Lenfestey | 292/54 X |
| 1,979,210 | 10/1934 | Rogers | 126/190 |
| 3,250,437 | 5/1966 | Smith | 214/84 X |
| 3,756,218 | 9/1973 | Simpson | 126/121 |

FOREIGN PATENT DOCUMENTS

| | | | |
|---|---|---|---|
| 113506 | 6/1929 | Austria | 126/190 |

*Primary Examiner*—William E. Wayner
*Assistant Examiner*—William E. Tapolcai, Jr.
*Attorney, Agent, or Firm*—Richard P. Crowley

[57] ABSTRACT

A log-burning stove which contains a full refractory firebox, the stove designed to permit the easy insertion of large, economical, wood logs, particularly green logs, which stove comprises a shell defining a combustion chamber, the combustion chamber fully lined with refractory material, and having an entrance and a full-length loading door adapted to permit the easy introduction of logs into the combustion chamber, the door adapted to move between a closed, upright, sealed position and an open supporting position extending generally laterally from the lower portion of the entrance opening, the door containing roller means on the internal surface thereof which provides for the lateral movement of a large log thereon which permits the positioning of the log adjacent the center of the entrance, whereby, after said positioning of the log adjacent the opening, the log may be moved inwardly through the entrance and into the combustion chamber.

13 Claims, 5 Drawing Figures

LOG-BURNING STOVE

BACKGROUND OF THE INVENTION

Wood stoves, particularly log-burning stoves, of antique and current design, are often quite unsatisfactory for the loading and burning of heavy logs, or for the satisfactory combustion of green logs therein. Such stoves often accomodate only logs of small or less than economical size, and, even if large enough to accept heavy full-length logs, such stoves do not provide provisions for the easy loading and inserting of the logs into the combustion chamber. Furthermore, such prior-art stoves are not designed to burn green logs, particularly large green logs. In addition, often stoves, antique or modern, tend to dissipiate a large amount of heat up the chimney, and do not provide an effective heat-sink design or a large enough surface-radiation area coupled with combustion efficiency. Therefore, there is a need for a scientifically designed log-burning stove which is easy to load, burns green logs and has an effective heat-sink design, and which will overcome other problems associated with prior-art stoves.

SUMMARY OF THE INVENTION

My invention is directed to a log-burning stove, a method of manufacturing the stove and of using and operating said stove. In particular, my invention is directed to a log-burning stove which provides for the easy loading or positioning of large, economical, heavy logs in a rapid and efficient manner. Furthermore, my invention is directed to a log-burning stove characterized by a full refractory design which permits the efficient combustion of large green logs. More particularly, my invention is directed to a log-burning stove which has a unique draft-control means which extends across a substantial length of the combustion chamber of the stove.

My stove permits the easy loading and inserting into the combustion chamber of large, heavy, economical logs, so that such logs may be inserted into the combustion chamber with a minimum of effort, so that a child or a woman can load the stove with such logs. For example, a child or woman may walk a full-size log along its ends and then tip the log onto the loading door of my stove, easily center the log adjacent the inlet or entrance of the combustion chamber and then move the log into the combustion chamber in particular by forcing the log into the combustion chamber employing the leverage of a long door handle to move the centered log into the combustion chamber by the upward movement of the loading door. Thus, my stove is designed to employ particularly large, economical, heavy logs which represent the most economical wood for combustion. For example, my stove is designed to permit the loading and combusting of logs of a size of over 30 inches in length, and logs having a diameter, for example, of greater than 9 inches; for example, 9 to 12 inches or higher. The large, economical, generally rectangular design of my stoves permits the stoves to hold two or more large logs or smaller combinations.

One feature of my stove is that it has a full refractory design, with the top, ends and back of the stove having refractory material about the combustion chamber or firebox, such as refractory plate material, which enhances the heat efficiency of my stove. The full refractory firebox of my stove maintains heat within the combustion chamber, and, therefore, the high temperature maintained permits the preheating and later burning of green logs, and also provides for the rapid burnoff of pyroligneous acid (creosote) with a minimum of flue or chimney clogging. By maintaining a high fire temperature in the refractory combustion chamber or firebox, logs inserted therein may be burned with very little fire required to maintain the high temperature level within the refractory firebox. In my stove, a fire is started at the rear of the firebox or combustion chamber employing a dry or soft-wood log that is used to start initially the combustion, and, thereafter, a green log, such as a second log, is placed in the front portion of the firebox adjacent the door, so that, while the rear log burns to coals, the front log or green log cooks or cures and moisture is driven off. Thereafter, when a new green log is inserted, employing my unique loading-door system, the front log, formerly a green log, now is reasonably cured and dried and may be rolled easily toward and to the rear portion of the firebox or combustion chamber onto the coals of the previous log, and the new green log occupies the former front or cooking position.

My stove also optionally eliminates the requirement of stack blowers to reclaim heat in that my stove provides for an adjustable top refractory plate and an upper plenum chamber above the combustion chamber, wherein there is an optional serpentine or baffle arrangement to provide for a tortuous flow path for the gaseous combustion gases discharged from the combustion chamber. This construction permits maximum extraction of heat from the hot combustion gases before being discharged from the flue of the stove. My adjustable top refractory material in addition permits easy adjustment, so that a desired amount of the serpentine or tortuous gaseous flow path may be utilized if desired, or the baffle elements may be avoided and the gaseous products may be discharged directly to the flue.

My stove, being a full refractory design and containing a metal shell enclosing the refractory firebox, provides a heat-sink design which, once heated, requires very little heat to maintain the desired temperature, with the stove radiating such heat slowly and evenly about a large radiation area. My stove, by employing a very large radiation area, together with its large mass heat sink, provides for a slow, even heat release once the high combustion temperature has been reached.

My stove also includes a unique draft-control means and feature which permits the employment of a long thin flow of air across almost the entire length of the firebox or combustion chamber of the stove, and provides for a better and rapid control of the draft than in prior-art stoves.

Also, my stove comprises means for the rapid and easy sealing adjustment of the bottom portion of the door against the bottom wall of the entrance to the combustion chamber. Although my stove will be described in one preferred embodiment as directed to the combustion of large and particularly green logs, it will be recognized by those persons skilled in the art that my stove may be employed for other purposes, and various modifications and changes may be made in the preferred embodiment of my stove and its operation, without departing from the spirit and scope of my invention.

DESCRIPTION OF THE EMBODIMENTS

Figure 1:
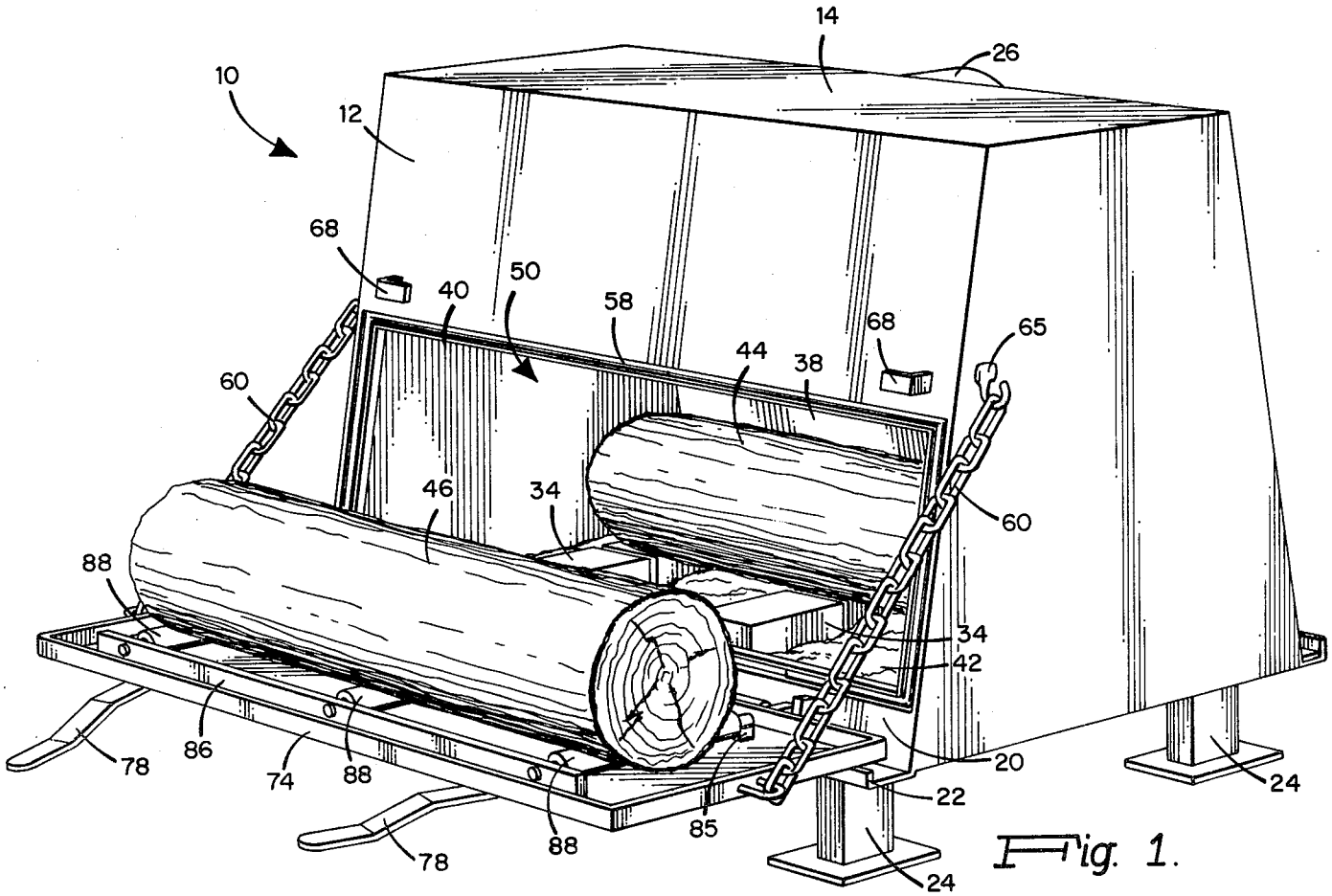
FIG. 1 is a perspective view of my stove with the loading door open.

My log-burning stove 10, which has a generally rectangular front and back trapezoidal end design, comprises a steel outer shell with a front upper wall 12, a top 14, a back wall 16, a bottom 18, a front lower wall 20 and supporting legs 24. A service lip or gutter 22 is welded to the front lower wall 20 directly beneath a rectangular door opening or entrance into the combustion chamber of the stove. A flue connector 26 is provided in the upper portion of the back wall 16 for the discharge of gaseous combustion products. The bottom 18 of the stove has a layer of particulate refractory material 42, such as sand, sloping from the back wall 16 toward the front lower wall 20 within the firebox or combustion chamber 50 defined by the outer shell. Within the firebox or combustion chamber are disposed three rows of fire bricks 34 retained in position by angle irons 32 on either side to support logs within the combustion chamber, with the upper surface of the fire bricks extending above the sand 42 level.

My stove contains a full refractory firebox wherein there is disposed rear refractory plate 38 typically composed of two plates which overlap in the center, with the plates of a size to permit the insertion of the plates through the entrance 50, and trapezoidal-type end refractory plates 40 and 41, the end plates each held in position by a plate clamp 62, the plate clamp held by screw 64.

The refractory plate material is assembled rapidly and easily within the stove. One end of the refractory plate 40 is placed in an upright position and is locked in place with clamp 62. Thereafter, one of the two rear refractory plates 38 is introduced through the entrance and is slid into position, with the one edge leaning against the back edge of the side plate 40. Then an adjustable refractory top plate 36 is placed into position, so that it rests on the top edge at one end of the side plate 40, and its back edge on the top edge of the first half of the rear plate 38. Thereafter, the second rear refractory plate 38 is introduced and is raised into its position, with one edge adjacent and preferably overlapping the other rear refractory plate edge to form plate 38. Thereafter, the end refractory plate 41 is raised in position and is locked into place with a second plate clamp 62 at the other end of the stove. The upper edge of the plate 41 then provides direct support for the other end of the adjustable top refractory plate 36. After such assembly, the firebox is lined on the sides and top with refractory plate material with sand on the bottom, with only two clamps required. In such assembly, the top refractory plate 36 is resting at each end on the top edge of each of the end plates 40 and 41. The top adjustable plate 36 has a width less than the width of the top edge of the side plates 40 and 41, and can be slid or moved forward or backward as desired. The top plate 36 provides the upper portion of my stove into an upper plenum chamber, which chamber contains a series of straight baffles 30 and a V-type baffle 28, whereby gaseous combustible products, passing upwardly from the lower combustion chamber, pass through the elongated open-slot area disposed by the top refractory plate, and pass into the upper chamber and optionally through the baffles 28 and 30 prior to being discharged from the flue 26.

Figure 2:
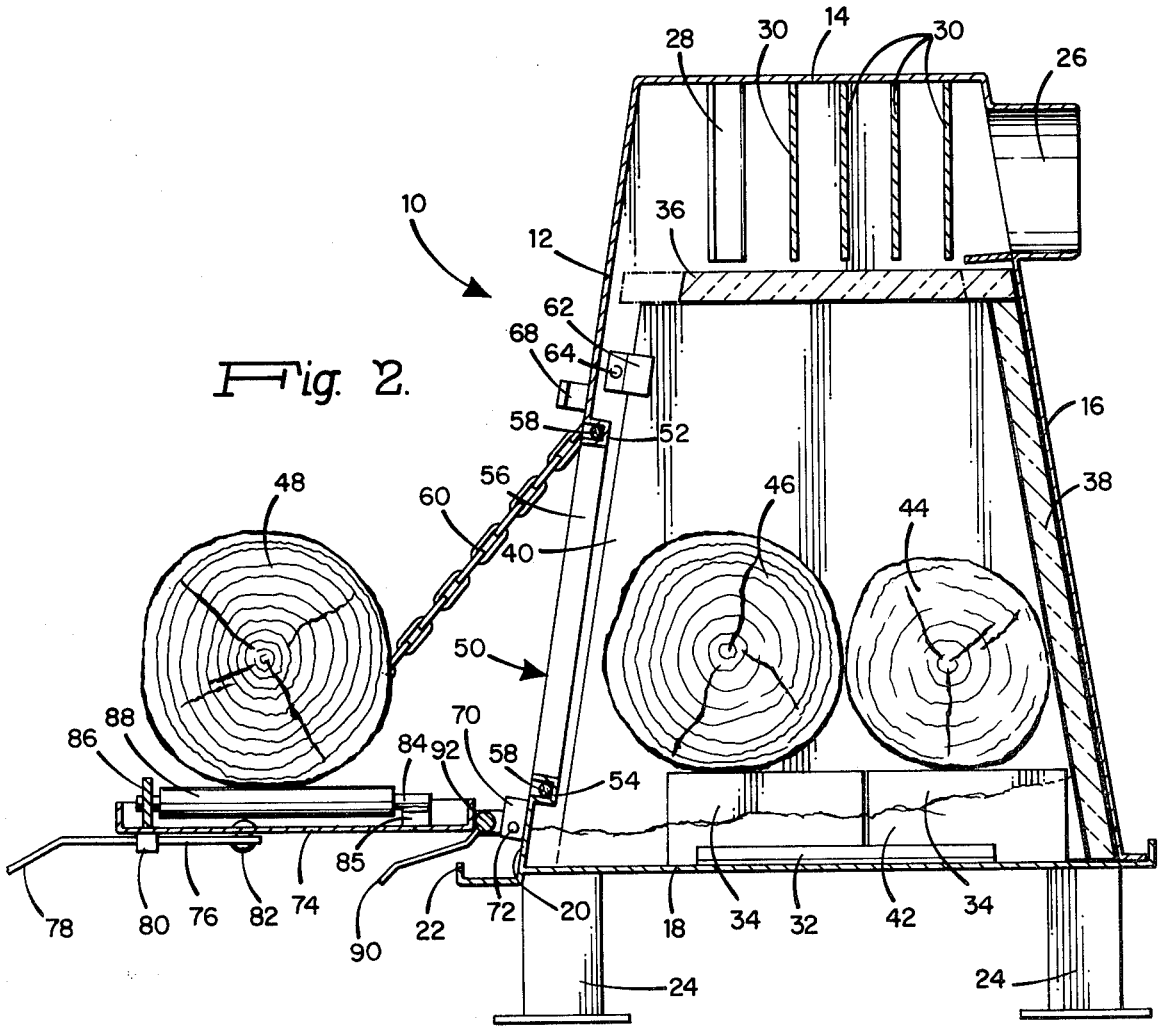
FIG. 2 is a cross-sectional view of my stove taken along the lines 2—2 of FIG. 3.

My design, therefore, permits a full refractory lining in my stove which is assembled easily, so that it can be interlocked and maintained in place by only two end clips, one at each end of the side refractory plates 40 and 41, and also permits an adjustable top refractory plate which, by movement forward or backward, passes whatever portion of the draft and gaseous combustion products desired through whatever portion of the baffles in the above chamber as desired. In FIG. 2, the top refractory plate 36 is shown as moved backward against the rear refractory plate 38, so that all of the draft passes through the entire baffles 28 and 30 system in the upper chamber before being discharged through the flue 26, with the top refractory plate 36 shown in dotted lines in its forward position where the gases pass directly onto the back of the stove to the flue connector. My baffles are utilized to extract heat by passage through the upper plenum chamber, or, where this is not desired, due to the low temperature of the combustion products, or if it is desired, to avoid the deposition of combustion products in the upper chamber, the adjustable refractory plate 36 may be moved forward for direct discharge of the products through the flue connector 26.

Figure 3:
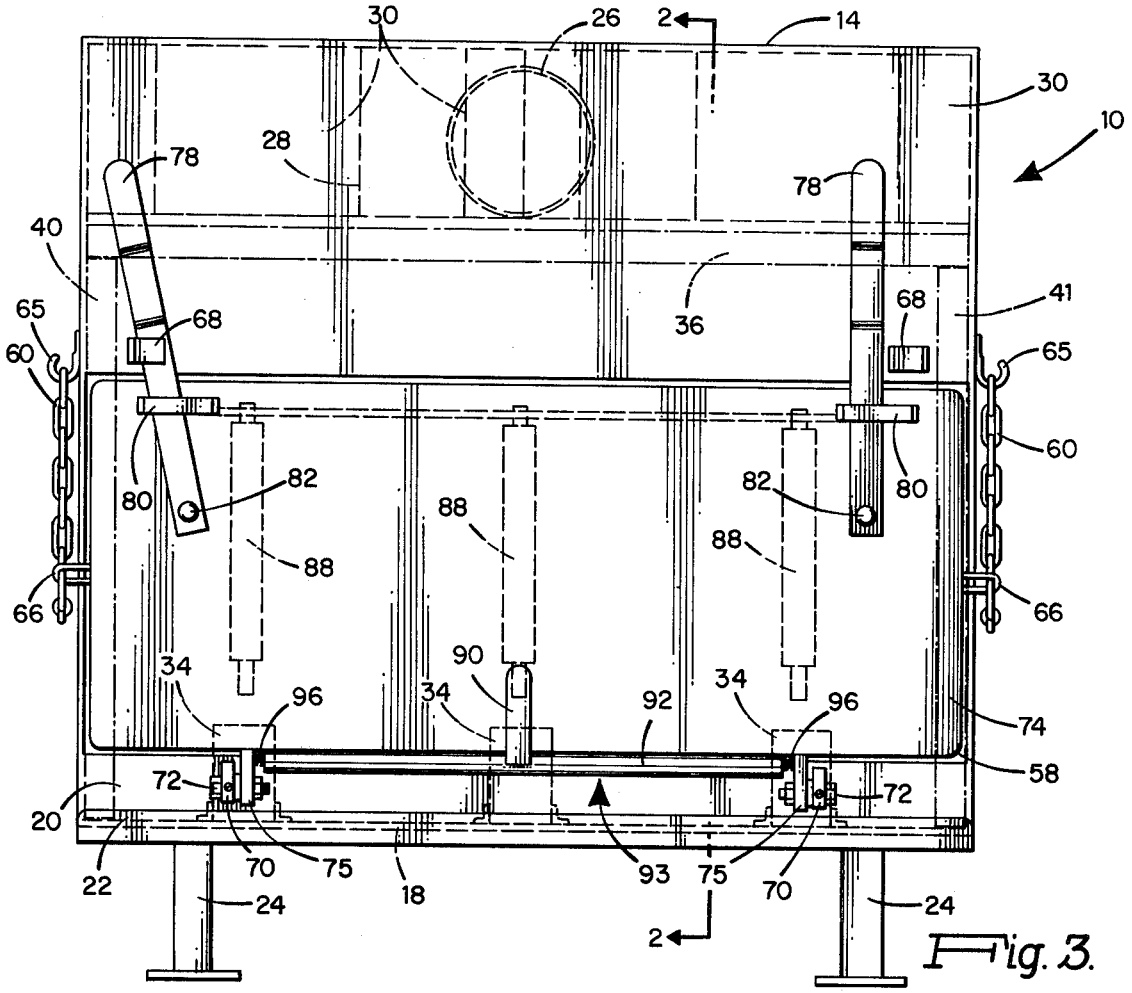
FIG. 3 is a front elevational view of my stove with portions of the loading means exposed.

For the purposes of illustration only, my stove is shown with a log 44 in the burning position against and adjacent the rear refractory plate 38 wall, with a second green log 46 in the forward cooking position and, for the purposes of illustration, with a log 48 placed on the open loading door ready to be moved into the firebox. Of course, during combustion, logs 44 and 46, both or only one, would remain in the firebox and the door would be closed. My stove includes a door opening 50 which extends the full length of the rectangular front wall to permit the insertion of the large economical-size logs. The opening is sealed by a door 74 which closes by upward movement against peripheral channels around the opening 50 which comprises a top seal channel 52, a bottom seal channel 54 and side seal channels 56, which channels contain a heat-sealing gasket 58 therein, such as a compressible asbestos gasket. As illustrated, the sealing gasket 58 only extends inwardly at each end of channel 54. In the open log-supporting and loading position, the door 74 is retained in an outwardly extended, generally lateral, horizontal position from the opening 50 by a pair of support chains 60 at each end thereof, one end of the chains secured to a door clamp 66 and the other end of the chain to a clamp 65. Above the entrance 50 and on either end of the front upper wall 12 are positioned open-angled door clamps 68, each designed to receive and retain the upper ends 78 of door handles 76. The ends 78 of the handles 76 are designed to fit within the door clamps 68, the door handles 76 pivoted at their lower ends through pivotable screws 82, and having lower support guides 80 on the door 74. The door handles 76 extend outwardly from the door 74 in the open loading position, so as to permit the user to employ the handles to provide leverage to the upward movement of the doors to move the heavy log on the door through the opening 50 and into the firebox. As illustrated in FIG. 3, the right-hand door handle 76 is shown in an upright unlocked position, while the left-hand door handle 76 is shown at an angled locked position within the door clamp 68.

The door 74 is positioned for movement between a closed and an open or loading position by hinge means which comprises a pair of hinge members 70 secured to the front lower wall 20 of the stove, the door secured to the hinge member 70 through hinge pins 72 and nut 73 and hinge member 75. The pin 72 is in an elongated slot 98, with a threaded set screw 99 to permit adjusting and positioning of the pin 72 in the slot 98.

The door 74 in the open or log-loading position includes a plurality of rollers 88 free-wheeling about fixed axles 84, one end of each axle being supported in an elongated roller support plate or rib 86, and the other end in individual support blocks 85 on the internal surface of the door. The roller surface is disposed above the surface of the rib 86 and supports 85. The rollers 88 are disposed generally parallel to each other and in the plane of the door 74 in the open position, with the door extending in a supported position generally laterally and horizontally outward from the entrance, and generally perpendicular from the plane of the opening 50. Any number of rollers may be employed, but typically the rollers should be spaced and be sufficient to provide for support of the logs to be used, and generally would comprise two or three rollers. The rollers are aligned to provide for lateral movement of the log placed therein generally parallel to the opening 50.

In operation, the log to be used is moved, for example, to one or the other sides of the door in the open position. The log is tilted onto the door and is pushed generally laterally onto the rollers 88, which permit easy lateral movement of the heavy log to a central position adjacent the opening 50. Thereafter, the log, once centered, may be moved easily into the firebox by the user's grasping the handle ends 78 and moving them upwardly to move the door 74 toward its upward closed position. The leverage afforded by elongated handles 76 permits the easy forward movement of the log into the firebox and onto the cooking position on the rows of fire bricks 34. Of course, if desired, the log merely may be rolled from its central position into the chamber without the use of the door leverage.

Figure 5:
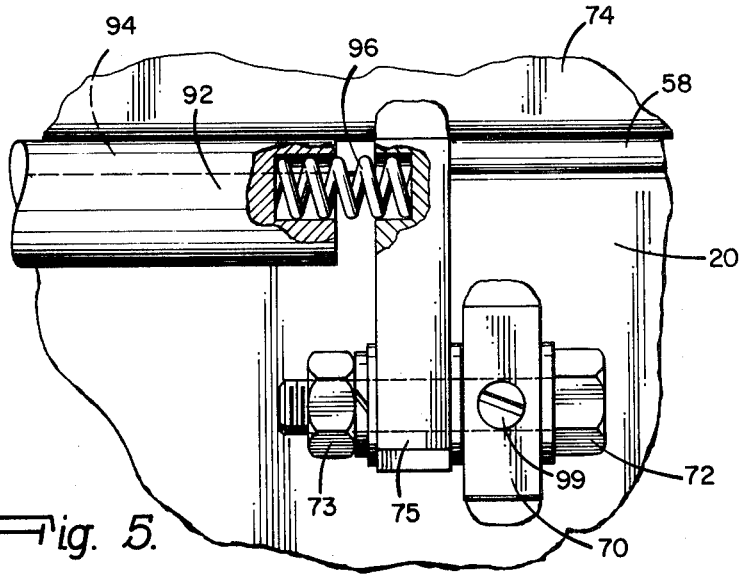
FIG. 5 is an enlarged partially cross-sectional fragmentary elevational front view of the draft-control and door-adjustment mechanisms of my stove.
Figure 4:
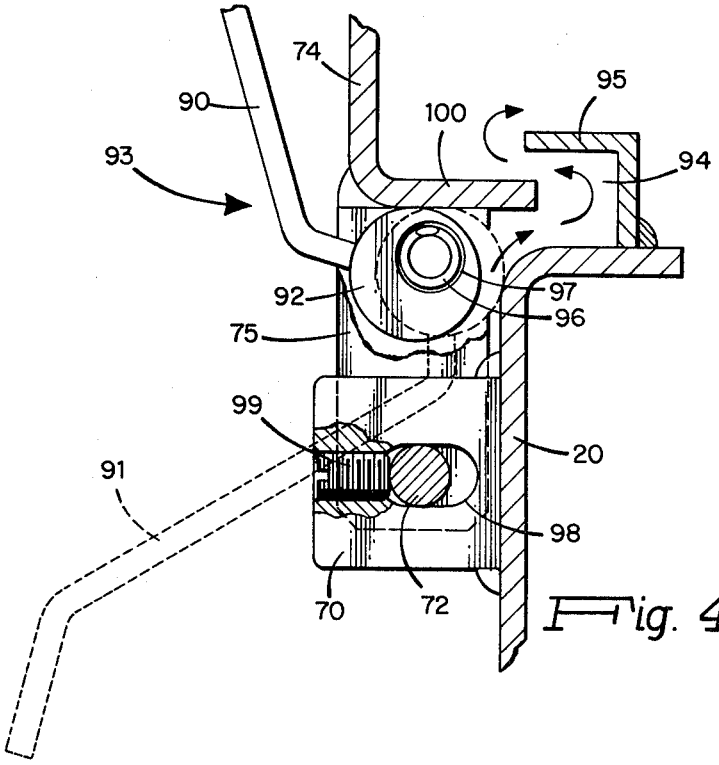
FIG. 4 is an enlarged partially cross-sectional fragmentary end view of the draft-control and door-adjustment mechanisms of my stove.

My stove includes a draft-control mechanism 93, shown more particularly in FIGS. 4 and 5, which comprises a draft-control handle 90 in the open position, and shown in dotted lines 91 in the closed position, and which is welded to an elongated, eccentrically mounted draft shaft or rod 92. The eccentric pivot points of the shaft 92 are a pair of stiff coiled springs 96 disposed in shaft opening 97 at each end, which springs 96 are disposed in hinge members 75, the springs 96 providing friction to adjust and to hold the draft rod 92 in place, and also to flex sideways or laterally to insure positive sealing contact with the lower flange bottom 100 of the door 74 and the lower portion 20 of the stove, when the draft rod is in the closed 91 position. This spring mechanism permits adjustment and positive closing of the draft, regardless of the dimensional error or adjustment of the door 74 sealing against the gasket 58 at each end. The springs 96 provide for dimensional differences which may often occur because of uneven heat expansion of the draft shaft 92 and the door 74. Typically, the shaft 92 and springs 96 remain cool, because of the cold airflow, while the door 74 tends to become quite hot up to 500° F. My draft system 93 provides for an elongated air-draft slot 98 which extends across a substantial length of the bottom portion of the door. The draft-control means permits a thin flow of air across almost the entire length of the firebox of the stove, as opposed to conventional drafts which often employ merely round draft holes. My full-length draft-control mechanism, on the eccentric pivotable movement of the shaft 92 by the handle, can control the opening of the draft slot 98, and, therefore, the air path 94, as defined by the bottom flange of the door and the angle 95 extension of the channel bottom 54. The mechanism provides a rapid and precise adjustment by about a 120° motion of the draft-control handle positions 90 and 91. In operation, the adjustable eccentric movement of the shaft 92, by the door handles between the closed position 91 and the open position 90, permits a flow of thin draft air across the lower edge of the door 74 into the firebox.

FIGS. 4 and 5 also show an additional detail of my door-adjusting mechanism, wherein hinge members 70 are welded to the front lower wall 20 of the stove, and have a slotted hole 98 for the insertion of the hinge pin 72, with a threaded set screw 99 bearing on the hinge pin 72. The bottom of the door 74 can be adjusted easily and rapidly by turning the set screw 99 inwardly against pin 72 in slot 98, which forces the lower portion or wall of door 74 at each end against the compressible asbestos door-sealing gasket 58.

My stove, therefore, as described and illustrated, provides for, in combination, a unique log-loading method, whereby large- and economical-size logs may be introduced easily into the firebox. A full refractory design for the firebox, with an adjustable top refractory plate, permits, in combination with a tortuous gaseous flow path, the saving of heat. A door-adjusting mechanism permits rapid and simple adjustment of the door in a sealing relationship against the lower gasket. A unique draft-control mechanism and system provides for a full-length draft flow across the substantial length of the firebox, and provides for quick and precise adjustment of such air-draft flow. My stove permits the combustion of large green logs in a unique burning system, and provides other advantages, as well as simplicity of operation and construction not heretofore provided by prior-art stoves.

What I claim is:

1. A log-burning stove which comprises:

(a) a shell defining a combustion chamber for the combustion of logs;

(b) a flue for the discharge of gaseous combustion products derived from the combustion of the logs;

(c) an entrance in one wall of the shell and into the combustion chamber for the introduction of logs into the combustion chamber;

(d) a door adapted to be placed in an open or a closed position, and which door, in the closed upright position, seals the entrance, and, in the open position, extends generally laterally outwardly adjacent to and from the lower bottom edge of the entrance;

(e) means to provide for the movement of the door between an open and a closed position; and (f) movable means positioned on the internal surface of the door and disposed in the plane of the door, which means comprises a plurality of spaced-apart, freely rotatable rollers, each roller disposed for rotation on a fixed axis element, the ends of the axis element supported on the interior of the door, the rollers disposed on a plane generally parallel to the door and the axis elements of the rollers being generally perpendicular to the entrance when the door is in the open position, the means adapted when the door is in fully the open position to permit the movement of a log on the surface of such means generally parallel to the entrance to the stove and to a position adjacent to the stove entrance and to permit the log so positioned to be moved thereafter on the rollers in a different direction through the stove entrance and into the combustion chamber.

2. The stove of claim 1 wherein the movable means comprises an elongated support rod secured to and extending along the upper interior surface of the door, a plurality of axial support blocks, a plurality of rollers, and a plurality of fixed axis elements disposed within each roller, one end of each axis element secured in the roller-support bracket, and the other end in a support block, the rollers supported for free-wheeling movement about the axis elements and generally parallel to the plane of the door and perpendicular to the entrance when the door is in the open position, the rollers adapted to receive and support thereon a heavy log and to permit the log to be moved laterally on the rollers, so that the log may be centered adjacent the stove entrance.

3. The stove of claim 1 which includes a pair of door handles, the door handles secured to the surface of the door and at each end thereof, the door handles pivoting about one end thereof on the door, and a pair of door clamp brackets secured to the upper front wall of the stove above the entrance, whereby, when the door is in the closed position, the elongated handles may be pivoted at one end and may be inserted and placed in the door clamps to retain the door in the upright closed position.

4. The stove of claim 1 wherein the stove includes a top refractory plate having a width less than the one-dimension plenum of the stove, which top plate defines an upper chamber and a lower combustion chamber, with a flow passageway between the chambers, the lower chamber defining the combustion area for the logs, and the upper chamber providing a heat-plenum chamber through which the gaseous combustion products pass, the flue opening into the upper chamber, and means to adjust the position of the refractory plate from the front to the back of said stove, so as to vary the flow path of the gaseous combustion products from the lower combustion chamber into the upper plenum chamber.

5. The stove of claim 4 wherein the stove includes refractory plate material on the sides of the stove, with end refractory plates opposing each other and supporting the ends of the top refractory plate, the top refractory plate having a width less than that of the side plates, so as to present an elongated opening between the lower combustion chamber and the upper plenum chamber, the position of which elongated opening may be varied from front to the rear of the stove by movement of the top refractory plate in the supporting position on the end refractory plates.

6. The stove of claim 4 wherein the upper heat-plenum chamber includes a plurality of baffle means therein to provide for the tortuous flow passage of gaseous combustion products from the lower gaseous chamber through the upper heat-plenum baffle chamber before discharging such gaseous products from the flue.

7. The stove of claim 6 wherein the baffle means comprises a plurality of generally parallel-line baffle plates in the upper heat-plenum chamber to provide for a serpentine flow of the gaseous-discharged products from the lower combustion chamber through said baffle elements and to the flue, when said adjustable top refractory plate is positioned with its back edge toward or against the back edge of the stove, and with the elongated opening formed by said top refractory plate between the upper and lower chambers extending generally above the entrance within the stove.

8. The stove of claim 1 wherein the stove is generally rectangular, with end portions of the stove being generally trapezoidal, and wherein the stove includes trapezoidal refractory end plates, end clamps to secure the plates in an upright position, a rear forward-sloping refractory plate, and a top refractory plate primarily supported on the opposing end trapezoidal plates, and wherein the entrance of the stove extends generally across the longest rectangular side of the stove.

9. The stove of claim 1 wherein the means to provide for the movement of the door between the open and closed positions comprises a pair of hinge elements, the hinge elements characterized by a slotted opening therein and a hinge pin in the slotted opening to connect hingedly the door to the hinge members, and means to adjust the position of the hinge pin within the elongated slot to adjust the position of the bottom portion of the door against the bottom wall edge of the entrance.

10. The stove of claim 1 which includes a draft-control means to control the flow of draft air into the combustion chamber, which control means comprises:

(a) an elongated opening to permit the passage of air into the combustion chamber;
(b) an eccentrically rotatable and mounted rod member extending generally adjacent and parallel to the elongated draft opening;
(c) means to secure the ends of the rod member for eccentric rotation; and
(d) handle means to move the rod member between a closed position, wherein the elongated rod member is disposed across the elongated opening to prevent the passage of air, and into an open position, wherein the elongated member is moved away from the elongated opening to admit draft air.

11. The stove of claim 10 wherein the draft-control means includes a tension means mounted at and extending from each end of the rod member to permit the adjustment of the rod member across the elongated opening.

12. The stove of claim 11 wherein the elongated opening is disposed between the lower wall edge of the door and the lower wall edge of the entrance of said stove, and wherein the means to move the essentially mounted shaft comprises an angular draft-control handle secured to said shaft, whereby movement of the handle, in a plane generally perpendicular to the entrance, provides for control of the draft.

13. A log burning stove which comprises:

(a) a shell defining a combustion chamber for the combustion of logs;
(b) a flue for the discharge of gaseous combustion products derived from within the combustion chamber;
(c) an insulating refractory lining within the shell which includes a plurality of refractory plates disposed within the shell and circumferentially about the sides and back of the stove and including a refractory top plate defining an upper flue chamber and a lower combustion chamber with an elongated flow passageway between the lower combustion chamber and the upper chamber, so that gaseous combustion products may pass in the combustion chamber through the upper chamber to the flue;

(d) baffle means disposed in the upper chamber to provide for the tortuous flow passage of gaseous combustion products from the lower combustion chamber through the flow passageway into the upper chamber before discharging such gaseous products from the flue;

(e) an entrance in one wall of the shell into the combustion chamber through the introduction of logs into the combustion chamber;

(f) a door adapted to be placed in an open supported position or a closed upright position and which door in the closed upright position seals the entrance and which door in the open supported position extends generally laterally outward adjacent to and from the lower bottom edge of the entrance;

(g) at least one door handle secured to the surface of the door, and pivoted about one end thereof and a door clamp bracket secured to the wall of the stove, the door handle extending generally outward from the plane of the door in the open position and which permits the door to be raised by leverage to the closed position once a log has been placed thereon whereby when the door is in the closed position, the elongated handles may be pivoted, placed in the door clamps to retain the door in the upright closed position;

(h) a draft control means to control the flow of draft air into the combustion chamber which control means comprises i. an elongated opening below the lower edge of the door to permit the passage of air into the combustion chamber;

ii. an eccentrically rotatable and mounted rod member extending generally adjacent and parallel to the elongated draft opening;

iii. means to secure the end of the rod member for eccentric rotation between a closed position wherein the elongated rod member is disposed across the elongated opening to prevent the passage of air and an open position wherein the elongated member is moved away from the elongated opening to omit draft air; and iv. means to move the rod member between open and closed position;

(i) hinge means to provide for the movement of the door between an open and closed position; and (j) means comprising a plurality of rollers disposed on the internal surface of the door, the rollers disposed on a plane generally parallel to the plane of the door and arranged generally perpendicular to the entrance when the door is placed in the open position, the means providing for log movement in a direction generally parallel to the entrance to enable the log to be positioned adjacent the entrance, and to permit the log so positioned to be moved inwardly through the entrance into the combustion chamber.

* * * * *